US011047036B2

(12) United States Patent
Viola et al.

(10) Patent No.: US 11,047,036 B2
(45) Date of Patent: Jun. 29, 2021

(54) METHOD OF FABRICATING A NITRIDED LOW-ALLOY STEEL PART

(71) Applicant: MESSIER-BUGATTI-DOWTY, Velizy Villacoublay (FR)

(72) Inventors: Alain Viola, Ernolsheim (FR); Nicolas Binot, Araux (FR)

(73) Assignee: MESSIER-BUGATTI-DOWTY, Velizy Villacoublay (FR)

( * ) Notice: Subject to any disclaimer, the term of this patent is extended or adjusted under 35 U.S.C. 154(b) by 204 days.

(21) Appl. No.: 16/450,154

(22) Filed: Jun. 24, 2019

(65) Prior Publication Data

US 2019/0309407 A1 Oct. 10, 2019

Related U.S. Application Data

(62) Division of application No. 15/042,196, filed on Feb. 12, 2016, now Pat. No. 10,344,370.

(30) Foreign Application Priority Data

Feb. 13, 2015 (FR) ..... 1551179

(51) Int. Cl.

| | |
|---|---|
| ***C23C 8/26*** | (2006.01) |
| ***C21D 6/00*** | (2006.01) |
| ***C23C 8/80*** | (2006.01) |
| ***C23C 8/02*** | (2006.01) |
| ***C22C 38/24*** | (2006.01) |
| ***C21D 1/06*** | (2006.01) |
| ***C23F 17/00*** | (2006.01) |
| ***C21D 3/04*** | (2006.01) |
| ***C21D 1/25*** | (2006.01) |
| ***C22C 38/22*** | (2006.01) |

(52) U.S. Cl.

CPC ..... *C23C 8/26* (2013.01); *C21D 1/06* (2013.01); *C21D 1/25* (2013.01); *C21D 3/04* (2013.01); *C21D 6/002* (2013.01); *C22C 38/22* (2013.01); *C22C 38/24* (2013.01); *C23C 8/02* (2013.01); *C23C 8/80* (2013.01); *C23F 17/00* (2013.01)

(58) Field of Classification Search

CPC ... C21D 1/06; C21D 1/25; C21D 3/04; C21D 6/002; C22C 38/22; C22C 38/24; C23C 8/02; C23C 8/26; C23C 8/80; C23F 17/00

See application file for complete search history.

(56) References Cited

U.S. PATENT DOCUMENTS

| | | | |
|---|---|---|---|
| 6,074,496 | A | 6/2000 | Yarita et al. |
| 2013/0180626 | A1 | 7/2013 | Yoshida |
| 2014/0166160 | A1 | 6/2014 | Prezeau |

FOREIGN PATENT DOCUMENTS

| | | | |
|---|---|---|---|
| EP | 2 749 666 | A2 | 7/2014 |
| KR | 2012-0111077 | A | 10/2012 |

OTHER PUBLICATIONS

"Microstructure of a Nitrided steel Previously Decarburized", Journal of Materials Engineering and Performance, vol. 15, No. 6, pp. 693-698 Calliari (Year: 2006).*

French Search Report as issued in French Patent Application No. 1551179, dated Jan. 13, 2016.

Calliari, I., et al., "Microstructure of a Nitrided Steel Previously Decarburized," Journal of Materials Engineering and Performance, vol. 15, No. 6, Dec. 2006, pp. 693-698.

Machine translation KR20120111077 from espacenet, generated Aug. 6, 2018 (Year: 2018).

* cited by examiner

*Primary Examiner* — Jenny R Wu

(74) *Attorney, Agent, or Firm* — Pillsbury Winthrop Shaw Pittman LLP

(57) ABSTRACT

A method of fabricating a nitrided low-alloy steel part, includes a) decarburizing the surface of a low-alloy steel part including at least one alloying element that is both nitride-forming and carbide forming in order to obtain a decarburized part presenting a carbon-depleted surface layer of thickness less than or equal to 1.5 mm, the minimum content of carbon by weight in the carbon-depleted surface layer being less than or equal to 70% of the carbon content by weight in the core of the decarburized part; b) treating the decarburized part with quenching treatment followed by annealing treatment; and c) nitriding the carbon-depleted surface layer in order to obtain a nitrided low-alloy steel part, step c) being performed after step b).

3 Claims, 6 Drawing Sheets

METHOD OF FABRICATING A NITRIDED LOW-ALLOY STEEL PART

CROSS-REFERENCE TO RELATED APPLICATIONS

This application is a divisional of U.S. application Ser. No. 15/042,196, filed Feb. 12, 2016, which in turn claims priority to French Patent Application No. 1551179, filed Feb. 13, 2015, the entire contents of which are incorporated herein by reference in their entireties.

FIELD

The invention relates to a method of fabricating parts out of nitrided low-alloy steel and also to decarburized low-alloy steel parts suitable for being subjected to nitriding treatment.

BACKGROUND

Low-alloy steels that are intended to be subjected to nitriding typically present a carbon content lying in the range 0.20% to 0.45% that serves to impart its mechanical properties to the core of the base material after heat treatment.

The surface properties of the steel, such as hardness, may be conferred by nitriding treatment, which consists in diffusing nitrogen into the ferritic phase and which causes submicroscopic nitrides to be precipitated from nitride-forming elements such as Cr, V, Mo, and Al that are present in solid solution in the treated steel.

Concretely, in a nitriding treatment, the steel may be treated at a temperature of about 500° C. with ammonia, which decomposes into cracked ammonia and reacts simultaneously with the iron of the steel. The ammonia causes a surface layer to be formed that is constituted by iron nitrides, referred to as a "compound" layer, from which nitrogen atoms diffuse towards the core of the part in order to form the diffusion layer.

For a low-alloy steel having nitride-forming elements, it is possible to observe two layers after nitriding: the compound layer at the surface constituted by iron nitrides, and the diffusion layer in which submicroscopic nitride precipitates are dispersed that lead to the increase in hardness that is observed in the nitrided layer.

The depth of the nitrided layer may vary, depending on nitriding conditions and on the intended applications, in the range 0.05 millimeters (mm) to 1 mm. Nevertheless, nitriding treatment remains treatment that is relatively lengthy to perform.

It would be desirable to further improve the surface properties of nitriding layers and to reduce the time required for nitriding treatment.

There thus exists a need to improve the surface properties, in particular the hardness, of nitrided layers formed at the surface of low-alloy steel parts.

There also exists a need to accelerate the apparent speed of treatment for nitriding low-alloy steel parts, i.e. for reducing the time needed to obtain a significant increase in hardness to a given depth, e.g. an increases of at least 200 on the Vicker's hardness scale (HV) compared with the hardness so the steel in the core.

SUMMARY

To this end, in a first aspect, the invention proposes a method of fabricating a nitrided low-alloy steel part, the method comprising the following steps:

a) decarburizing the surface of a low-alloy steel part including at least one alloying element that is both nitride-forming and carbide-forming in order to obtain a decarburized part presenting a carbon-depleted surface layer of thickness less than or equal to 1.5 mm, the minimum content of carbon by weight in the carbon-depleted surface layer being less than or equal to 70% of the carbon content by weight in the core of the decarburized part;

b) treating the decarburized part with quenching treatment followed by tempering treatment; and c) nitriding the carbon-depleted surface layer in order to obtain a nitrided low-alloy steel part, step c) being performed after step b).

The term "low-alloy steel" should be understood as meaning a steel in which no alloying element is present at a content by weight of greater than 5.00%. In other words, in a low-alloy steel, each of the chemical elements, other than iron, is present at a content by weight that is less than or equal to 5.00%.

The term "alloying element that is both nitride-forming and carbide-forming" should be understood as meaning an alloying element that is present in the steel in the form of a carbide prior to step c) and that is suitable for forming a nitride during step c). As examples of alloying elements that are both nitride-forming and carbide-forming, mention may be made for example of the following elements: Cr, Mo, and V.

The carbon content by weight in the core of the part does not vary during step a). In other words, the surface decarburizing that is performed during step a) affects carbon content only in the surface layer of the part and not in its core.

It is possible for the carbon content by weight to vary as a function of depth within the carbon-depleted surface layer. Thus, the term "minimum carbon content by weight in the carbon-depleted surface layer" should be understood as the minimum value that is reached by the carbon content by weight on moving depthwise through the carbon-depleted surface layer parallel to the gradient of carbon content by weight.

By way of example, the carbon content by weight may be measured with a Castaing microprobe by using the procedure set out in the standard ASTM E1019. The carbon content by weight in the core of the decarburized part (corresponding to that of the part prior to decarburizing) may for example lie in the range 0.20% to 0.45%.

In an embodiment of the invention, the minimum carbon content by weight in the carbon-depleted surface layer is less than or equal to 70% of the carbon content by weight in the core of the decarburized part. In other words, the minimum content of carbon by weight in the carbon-depleted surface layer is less than or equal to 0.70×(carbon content by weight in the core of the decarburized part).

The inventors have found that the layer obtained by nitriding does not present optimum properties if carbon is present in too great a quantity in the surface layer of the part prior to nitriding treatment. Under such circumstances, there is a high content of carbides in the surface layer prior to nitriding, and this can constitute a problem.

The nitrides obtained by nitrogen taking the place of carbon in the carbides (in situ precipitation of nitrides) during the nitriding treatment have a hardening potential that is smaller than that of nitrides that are obtained by precipitation from nitride-forming elements that were initially present in solid solution in the ferritic matrix. Furthermore, during nitriding, the carbon that was initially present in the carbides of the surface layer can be released and can diffuse upstream from the nitrogen diffusion front. The carbon that is released in this way can precipitate in the form of cementite networks at the grain boundaries, and can thus degrade the mechanical properties of the nitrided layer.

Thus, an aspect of the invention is based on performing decarburizing treatment of the surface of the part prior to the nitriding treatment in order to reduce the quantity of carbides present at the surface of the part, and thus be unaffected by the above-mentioned undesirable effects of carbon, while conserving good properties in the core of the part away from the surface layer. The decarburizing treatment performed during step a) makes it possible to obtain a surface layer of chemical composition that is optimized for receiving the nitriding treatment as a result of at least some of the carbides being eliminated by the decarburizing treatment, which carbides contribute during nitriding to forming networks of carbides/carbonitrides that are harmful for the mechanical strength of the nitriding layer.

An aspect of the invention beneficially makes it possible to increase the surface hardness of the nitrided part significantly and to obtain compression stress fields that are more intense, thereby enabling the fatigue strength of the steel part as treated in this way to be considerably improved. In particular, the aspect of the invention makes it possible to reduce or even to eliminate the quantity of embrittling cementite networks. In addition, the aspect of the invention makes it possible to increase the apparent speed of nitriding significantly because of the reduction in the quantity of surface carbon in the part, thereby leading to nitrogen having a greater contribution to the hardening mechanism. Thus, compared with the situation in which step a) is not performed prior to nitriding, parts treated by the method of an aspect of the invention present greater hardness in the nitriding layer for identical nitrogen content, which amounts to the speed of nitriding apparently accelerating (nitriding takes place as though more nitrogen were present at a given depth in parts that have been treated by the method of an aspect of the invention).

An aspect of the invention thus makes it possible quickly to obtain nitrided layers that are deep, e.g. having a depth of 0.7 mm. The increase in the apparent speed of nitriding also beneficially makes it possible to limit the relaxation of residual stresses in the nitriding layer because it is possible to reduce the time of exposure to the nitriding temperature.

The intermediate quenching and tempering step serves to confer its properties on the base steel. In one implementation, quenching (cooling) may be performed from the decarburizing temperature, after which tempering is then performed. In a variant, it is possible to begin by cooling the decarburized part, e.g. down to ambient temperature (20° C.), and then to perform austenitization and, after austenitization, to perform quenching treatment followed by tempering treatment.

In an implementation, the minimum content of carbon by weight in the carbon-depleted surface layer may be less than or equal to 60% of the carbon content by weight in the core of the decarburized part. In other words, the minimum content of carbon by weight in the carbon-depleted surface layer may be less than or equal to 0.6×(carbon content by weight in the core of the decarburized part).

Nitriding may be performed under conventional conditions using any type of nitriding method known to the person skilled in the art. The atmosphere, temperature, and time settings are defined as a function of the base steel and of the looked-for characteristics.

In an implementation, the thickness of the carbon-depleted surface layer may lie in the range 0.3 mm to 1.5 mm.

In an implementation, the minimum content of carbon by weight in the carbon-depleted surface layer may be greater than or equal to 0.05%.

The presence of such a minimum carbon content in the carbon-depleted surface layer serves beneficially to provide a significant increase in the surface hardness of the part after nitriding.

By way of example, the treated low-alloy steel part may be made of 32CrMoV13, 35CrMo4, 15CrMoV6, or X38CrMoV5 steel. The treated low-alloy steel part may, in an embodiment, be made of 32CrMoV13 steel.

In an implementation, it is possible during step a) to treat the low-alloy steel part with an oxidizing atmosphere containing water vapor while imposing a temperature lying in the range 850° C. to 1000° C., the oxidizing atmosphere having a dew point temperature lying in the range −40° C. to +20° C., e.g. lying in the range −10° C. to +10° C., e.g. in the range −4° C. to +4° C.

In a variant, in step a), it is possible to treat the low-alloy steel part with air at a temperature of 950° C. in order to perform the desired decarburizing.

In an implementation, it is possible, prior to step c), to perform a step of machining the carbon-depleted surface layer.

Performing such a machining step is beneficial since it makes it possible to eliminate the non-desirable oxidized layer that may form during decarburizing. This oxidized layer may typically have a thickness that is less than or equal to a few hundredths of a millimeter.

There exist other ways of reducing the quantity of surface oxides in the decarburized part, and it is thus possible for example to subject the decarburized part to treatment in a reducing atmosphere, e.g. including $H_2$, prior to step c).

The step of machining the carbon-depleted surface layer may be performed before and/or after step b).

In an implementation, it is possible, after step c), to perform a step of machining the nitrided layer formed during step c).

Performing such a machining step may make it possible to eliminate the compound layer that is formed during the nitriding treatment, with only the diffusion layer that is formed during this treatment being conserved.

In an implementation, it is possible to seek to obtain a carbon-depleted surface layer after performing step a) only in one or a plurality of predefined zones of the surface of the part. Under such circumstances, it is possible, by way of example, to coat the surface of the low-alloy steel part prior to step a) with a mask in order to perform decarburizing only in one or a plurality of predefined zones of the surface of the part as defined by the mask. By way of example, it is thus possible to deposit a varnish that forms an oxygen barrier on the surface of the part, with the zone(s) on which the varnish has not been deposited being for decarburizing during step a).

It is also possible, prior to step c), to eliminate a portion of the carbon-depleted surface layer in order to retain it in only one or a plurality of predefined zones of the surface of the part.

An aspect of the present invention also provides a decarburized low-alloy steel part including at least one alloying element that is both nitride-forming and carbide-forming, presenting a carbon-depleted surface layer of thickness less than or equal to 1.5 mm that is to be subjected to nitriding, the minimum carbon content by weight in the carbon-depleted surface layer being less than or equal to 70% of the carbon content by weight in the core of the decarburized part.

Such a part corresponds to an intermediate product obtained by performing above-described step a) prior to performing the nitriding step c).

In an embodiment, the carbon-depleted surface layer may present a thickness lying in the range 0.3 mm to 1.5 mm.

In an embodiment, the low-alloy steel may be 32CrMoV13 steel.

The various characteristics described above for the method of an aspect of the invention relating to the carbon-depleted surface layer and to the low-alloy steel used also apply to the aspect of the invention relating to the part.

BRIEF DESCRIPTION OF THE DRAWINGS

Other characteristics and advantages of the invention appear from the following description made with reference to the accompanying drawings, in which.

DETAILED DESCRIPTION

Figure 1:
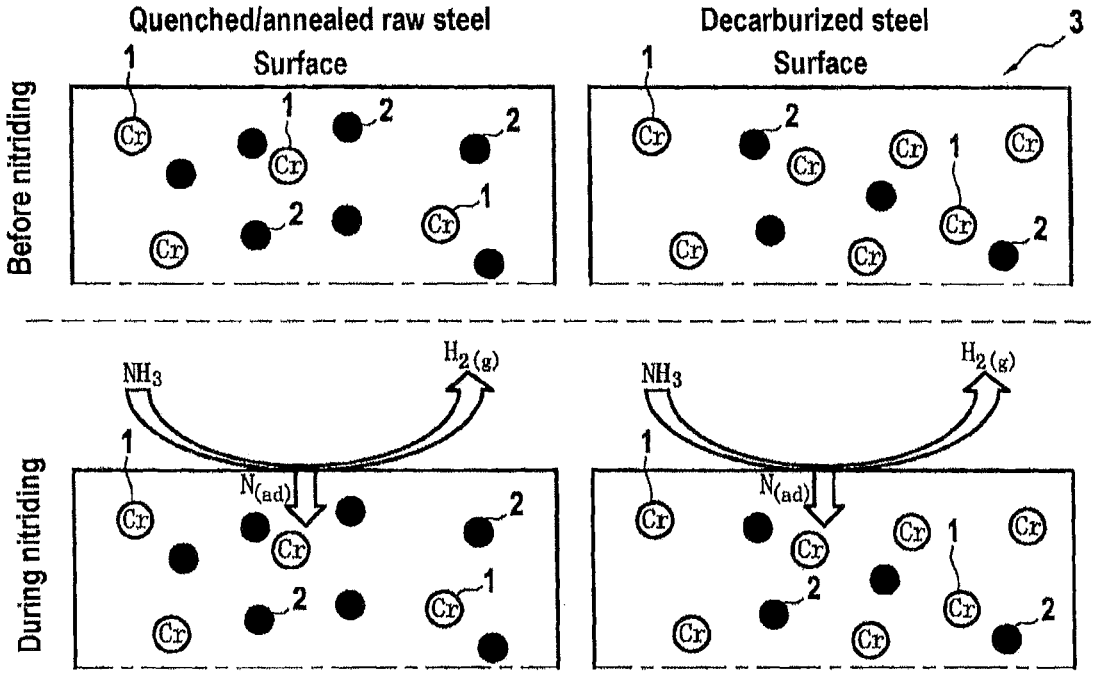
FIGS. 1 to 3 are highly diagrammatic, showing how the surface composition of a low-alloy steel part varies during nitriding treatment depending on whether or not the part has been decarburized.
Figure 2:
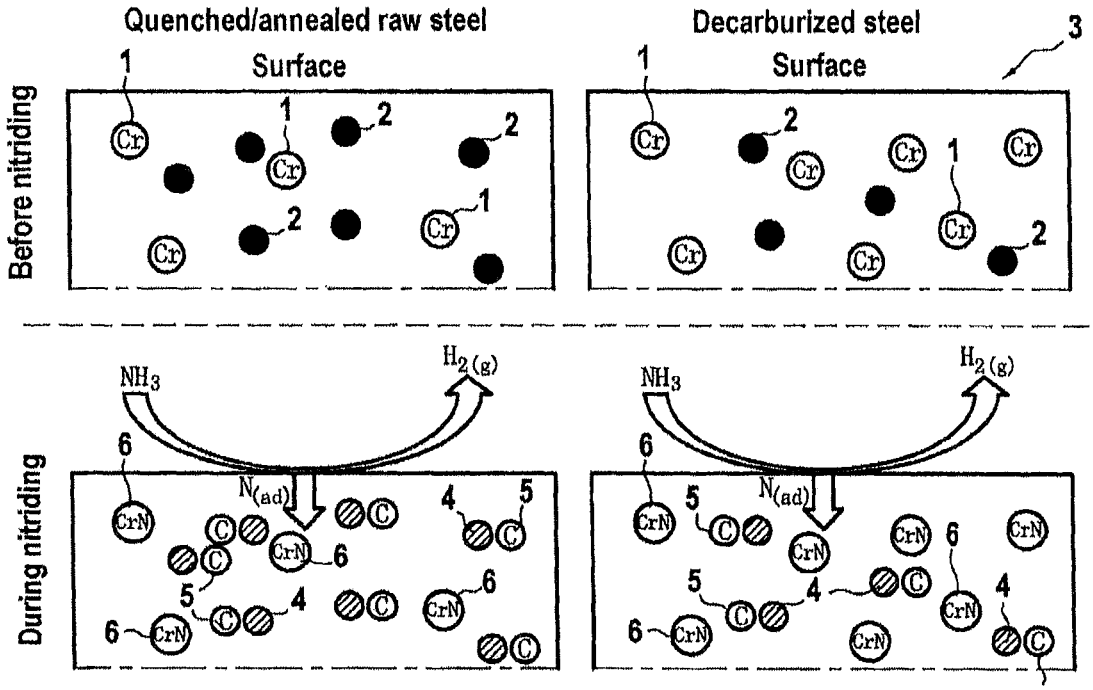
Figure 3:
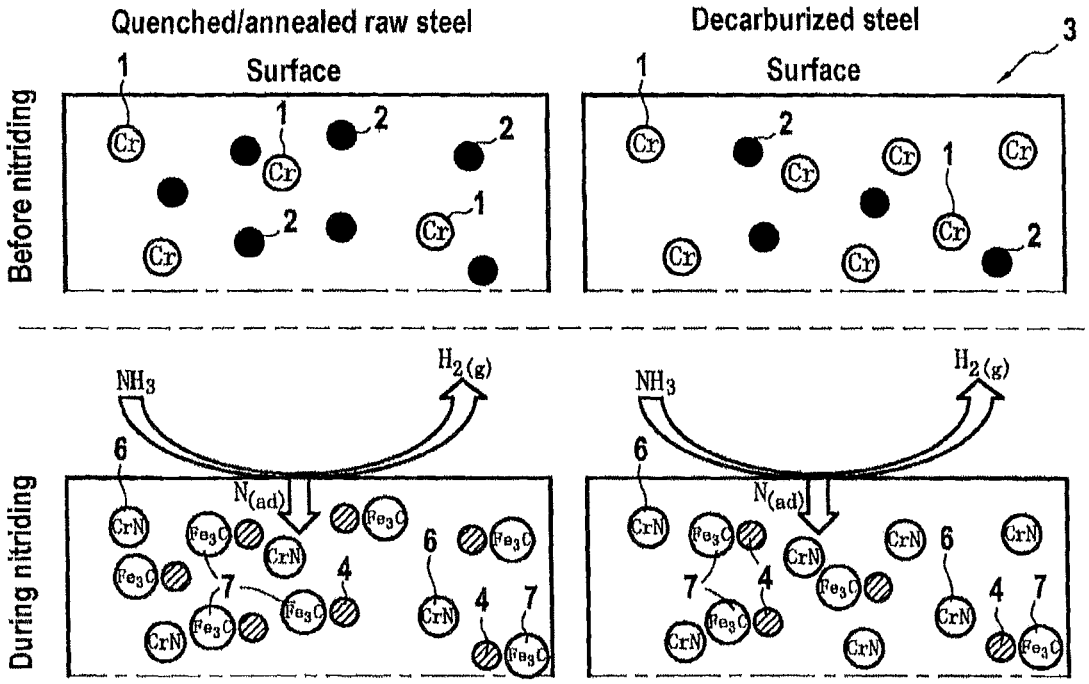

FIGS. 1 to 3 are highly diagrammatic and they show how the surface composition of a low-alloy steel part varies during nitriding treatment depending on whether the part has been decarburized ("decarburized steel") or not ("quenched/tempered raw steel").

In both situations, the part presents at its surface both chromium 1 in solid solution and chromium-enriched carbides 2 referred to as chromium carbides. In its carbon-depleted surface layer 3, the decarburized part includes a quantity of chromium carbide 2 that is smaller than that of the non-decarburized part. The low-alloy steel can enable a martensitic, bainitic/martensitic, or a bainitic structure to be obtained in the carbon-depleted surface layer after quenching. During nitriding, the part may be treated, by way of example, by means of a stream of gas comprising ammonia.

FIGS. 2 and 3 are diagrams showing how the surface composition of the part varies during nitriding and they compare it to the surface composition of the part before nitriding. As shown in FIG. 2, during nitriding, chromium carbides 2 are converted into chromium nitrides 4 obtained from the carbides, and carbon 5 is released. The chromium 1 in solid solution is converted during nitriding into chromium nitrides 6 that come from the chromium in solid solution.

As mentioned above, chromium nitrides 4 can confer lower hardness to the nitrided layer than chromium nitrides 6. The nitrided layer obtained when the part has previously been decarburized thus beneficially presents better hardness because it has a smaller proportion of chromium nitrides 4.

Furthermore, and as shown in FIG. 3, if the content of released carbon 5 exceeds a certain threshold, then cementite networks 7 can appear and they can embrittle the resulting layer of nitriding. When decarburizing is not performed before nitriding, a larger number of embrittling cementite networks 7 are formed because of the greater quantity of carbon 5 that is released during nitriding.

EXAMPLES

Example 1

A 32CrMoV13 type nitriding steel in the annealed state was initially decarburized by treatment in an oxidizing atmosphere containing water vapor and presenting a dew point of +4° C. at a temperature of 950° C. for 6 hours.

Figure 4:
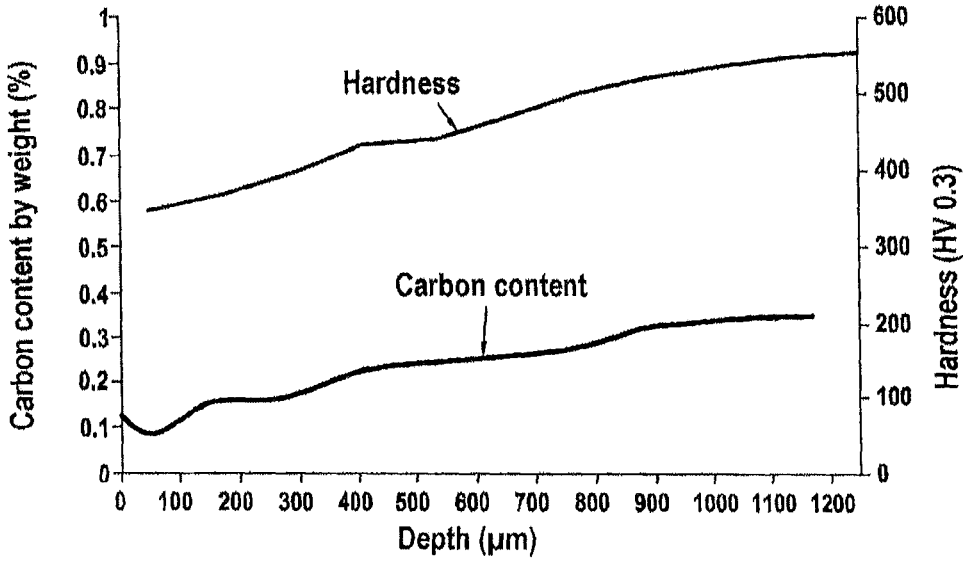
FIGS. 4, 7, and 10 show in particular the results of measurements obtained by a Castaing microprobe showing how the content by weight of carbon varies in a part that has had its surface decarburized.

FIG. 4 shows the variation in the carbon content by weight as a function of depth and variation in the hardness of the resulting part made of decarburized low-alloy steel. As shown, such decarburizing treatment leads to obtaining a carbon content of about 0.12% at the surface of the carbon-depleted surface layer (depth 0 micrometers (μm)), the carbon content returning to that of the base steel at a depth of about 0.85 mm. The minimum carbon content by weight in the carbon-depleted surface layer as obtained in this way is about 0.08%.

Following this decarburizing treatment, oil quenching was performed and then tempering treatment was performed at a temperature of 635° C. for 4 hours under an atmosphere of $N_2$+10% $H_2$. A second oil quench was performed after the tempering treatment.

Nitriding under an atmosphere made up of 50% $NH_3$, 37.5% $H_2$, and 12.5% $N_2$ at a temperature of 520° C. for a duration lying in the range 101 hours to 113 hours was performed.

Figure 5:
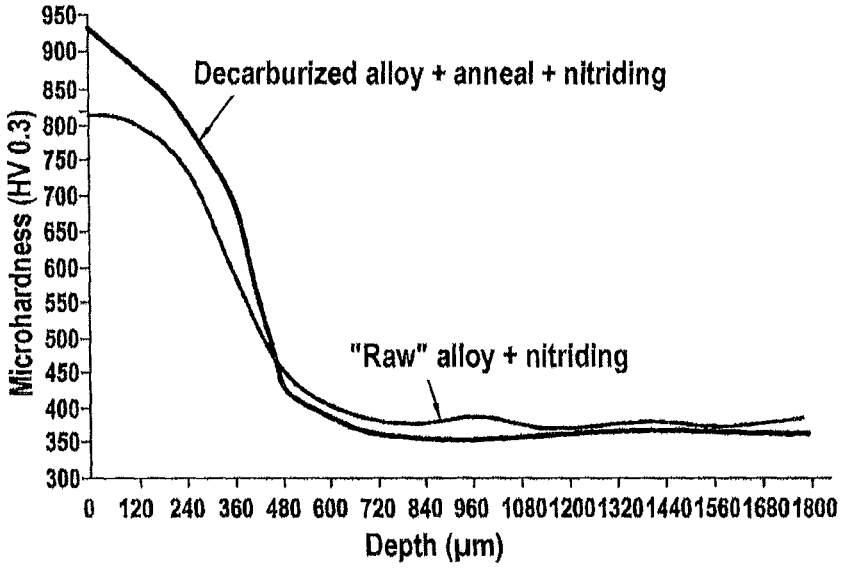
FIGS. 5, 6, 8, 9, and 11 show the results of measurements comparing the hardness obtained for nitrided parts depending on whether they have or have not previously been subjected to surface decarburized treatment.

FIG. 5 shows the results of microhardness measurements for the nitrided low-alloy steel part obtained in the present example ("decarburized alloy+tempering+nitriding"). By way of comparison, FIG. 5 shows the microhardness measurements obtained when the same steel is subjected to treatment that differs only in that decarburizing was not performed ('raw "alloy"+nitriding'). It can be seen that, as a result of performing decarburizing prior to nitriding, performing a method of an aspect of the invention makes it possible, to improve significantly the surface hardness of the resulting part. The offset to the right of the curve relating to performing decarburizing treatment compared with the '"raw" alloy plus nitriding' curve also shows that the apparent speed of nitriding is improved in the context of the invention.

Figure 6:
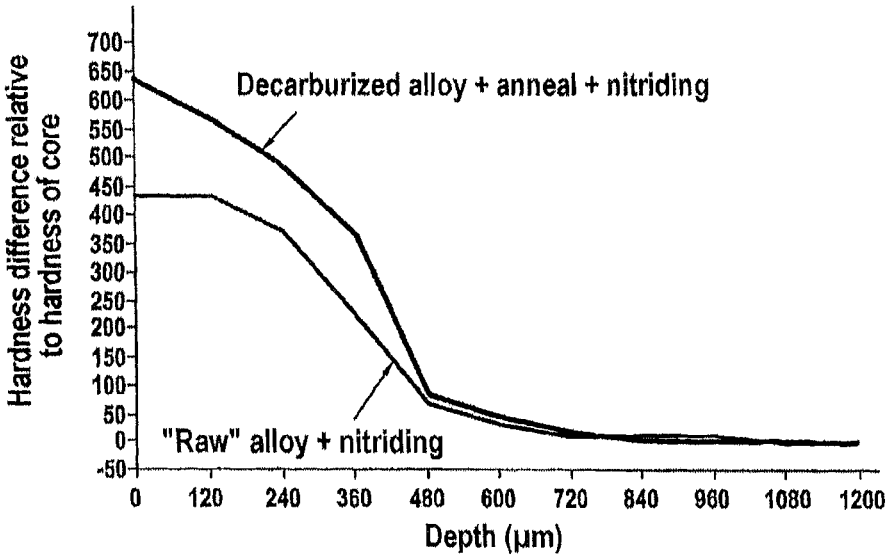

FIG. 6 shows how the difference in hardness varies relative to the hardness of the core as a function of depth for a part obtained in accordance with Example 1 or obtained under conditions identical to those of Example 1, except that the decarburizing treatment was not performed. It can be seen that the part obtained in accordance with Example 1 results in a significant increase in surface hardness of about 32% (637-436/637).

Example 2

A 32CrMoV13 type nitriding steel in the annealed state was treated under the same conditions as in Example 1. The only difference lay in the fact that decarburizing was performed at a temperature of 980° C. and not at 950° C.

Figure 7:
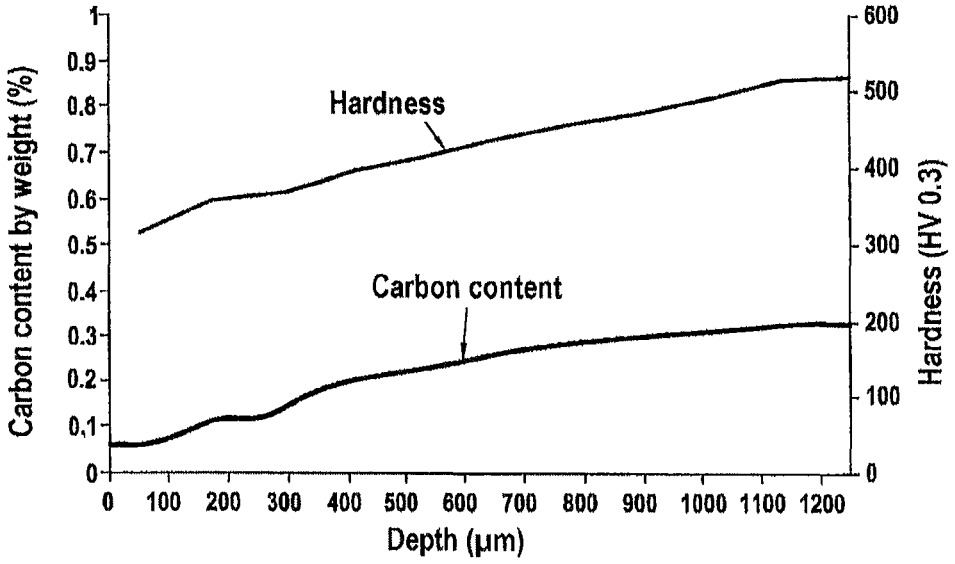

FIG. 7 shows how the carbon content by weight and the hardness of the decarburized low-alloy steel part as obtained in that way vary as a function of depth. As shown, such decarburizing treatment leads to obtaining a carbon content of less than 0.10% at the surface of the carbon-depleted surface layer (depth 0 μm), the carbon content returning to that of the base steel at a depth of about 0.9 mm. The carbon content at the surface of the carbon-depleted surface layer in this example corresponds to the minimum content of carbon by weight in the carbon-depleted surface layer.

Figure 8:
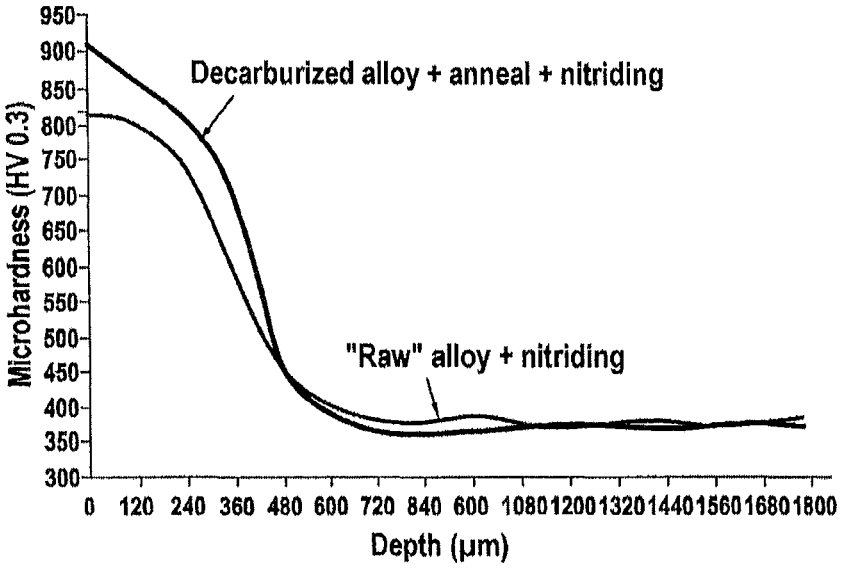

FIG. 8 shows the results of microhardness measurements for the nitrided low-alloy steel part obtained in the context of the present example ("decarburized steel+tempering+nitriding"). By way of comparison, FIG. 8 shows the microhardness measurements obtained when the same steel is subjected to treatment that differs only in that decarburizing is not performed ('"raw" alloy+nitriding'). It can be seen that performing the method of an aspect of the invention makes it possible, as a result of performing decarburizing between nitriding, to significantly improve the surface hardness of the resulting part. The shift to the right of the curve relating to performing decarburizing treatment compared with the '"raw" alloy+nitriding' curve also shows that the apparent speed of nitriding is improved in the context of the invention.

Figure 9:
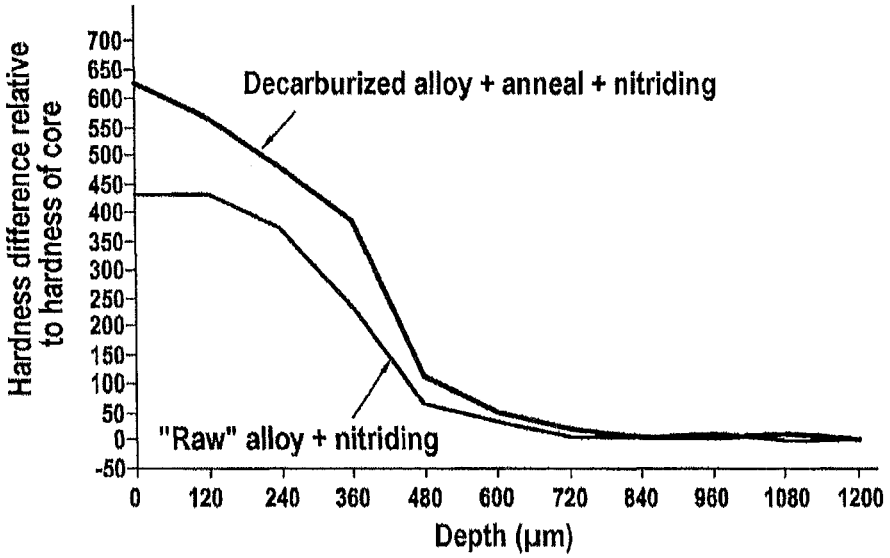

FIG. 9 shows how the difference in hardness compared with the hardness of the core varies as a function of depth for the part obtained in Example 2 or obtained under conditions that are identical to those of Example 2, with the exception that the decarburizing treatment was not performed. It can be seen that for the part obtained in accordance with Example 2 a significant increase in surface hardness was obtained of about 30% (627-436/627).

Example 3

A 32CrMoV13 type nitriding steel in the annealed state was initially decarburized by treatment with an oxidizing atmosphere containing water vapor and presenting a dew point of 0° C. at a temperature of 950° C. for 6 hours.

Figure 10:
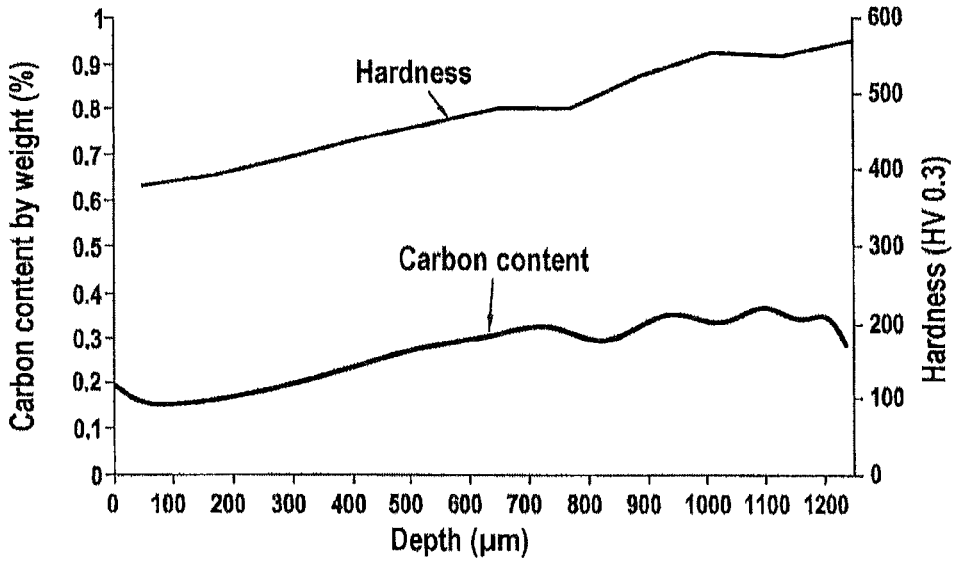

FIG. 10 shows how the carbon content by weight and the hardness of the decarburized low-alloy steel part as obtained in this way vary as a function of depth. As shown, such decarburizing treatment leads to a carbon content being obtained of about 0.20% at the surface of the carbon-depleted surface layer (depth 0 μm), the carbon content returning to that of the base steel at a depth of about 0.85 mm. The minimum content by weight of carbon in the carbon-depleted surface layer as obtained in this way is about 0.16%.

After this decarburizing treatment, oil quenching was performed followed by tempering treatment at a temperature of 635° C. for 4 hours under an atmosphere of $N_2$+10% $H_2$. A second oil quench was performed after the tempering treatment.

Nitriding under an atmosphere made up of 50% $NH_3$, 37.5% $H_2$, and 12.5% $N_2$ at a temperature of 550° C. for a duration of 55 hours was performed.

Figure 11:
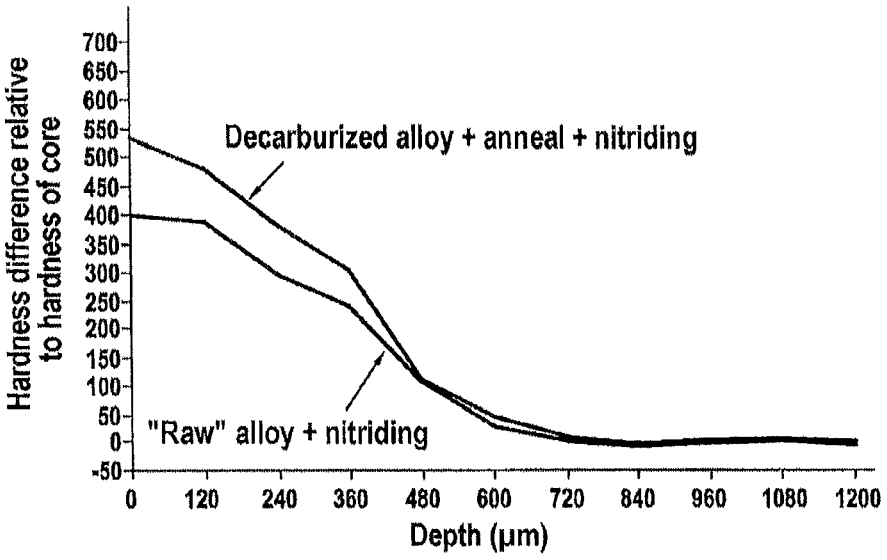

FIG. 11 shows how the difference in hardness relative to the hardness of the core varies as a function of depth for a part obtained in accordance with Example 3 ("decarburized alloy+tempering+nitriding") or as obtained under conditions identical to those of Example 3 with the exception that the decarburizing treatment was not performed ('"raw" alloy+nitriding'). It can be seen that for the part obtained in accordance with Example 3 a significant increase in surface hardness was obtained.

The term "including/comprising a" should be understood as "including/comprising at least one".

The term "lying in the range . . . to . . . " or "going from . . . to . . . " should be understood as including the limits.

The invention claimed is:

1. A decarburized low-alloy steel part including at least one alloying element that is both nitride-forming and carbide-forming, presenting a carbon-depleted surface layer beginning from a surface of the low-alloy steel part to a depth of less than or equal to 1.5 mm that is to be subjected to nitriding, wherein a minimum content of carbon by weight, $C_{minimumcarbondepletedsurfacelayer}$, in the carbon-depleted surface layer is defined as follows:

$$0.05\text{ wt }\% \leq C_{minimumcarbondepletedsurfacelayer} \leq 0.7 * C_{carboncore}$$

wherein $C_{carboncore}$ is the carbon content by weight in the core of the decarburized part, and wherein a maximum content of carbon by weight in the carbon-depleted surface layer is less than or equal to 0.45%.

2. The part according to claim 1, wherein the carbon-depleted surface layer presents a thickness lying in the range 0.3 mm to 1.5 mm.

3. The part according to claim 1, wherein the low-alloy steel is 32CrMoV13 steel.

* * * * *